United States Patent [19]

Kosugi et al.

[11] Patent Number: 5,068,681

[45] Date of Patent: Nov. 26, 1991

[54] DRYING AIR CONTROL METHOD IN AN AUTOMATIC DEVELOPING MACHINE AND AN AUTOMATIC DEVELOPING MACHINE EMPLOYING THE METHOD

[75] Inventors: Hiromitsu Kosugi; Shinichi Otani; Teruo Kashino; Masakazu Andoh; Takeo Arai; Toshiharu Nagashima, all of Hino, Japan

[73] Assignee: Konica Corporation, Tokyo, Japan

[21] Appl. No.: 540,909

[22] Filed: Jun. 20, 1990

Related U.S. Application Data

[63] Continuation of Ser. No. 329,419, Mar. 27, 1989, Pat. No. 4,952,960.

[30] Foreign Application Priority Data

| | | | |
|---|---|---|---|
| Mar. 30, 1988 | [JP] | Japan | 63-77662 |
| May 23, 1988 | [JP] | Japan | 63-126592 |
| Jun. 6, 1988 | [JP] | Japan | 63-140254 |
| Feb. 17, 1989 | [JP] | Japan | 1-37875 |

[51] Int. Cl.[5] ..... G03D 3/08; F26B 21/08; F26B 21/10

[52] U.S. Cl. ..... 354/299; 34/46; 34/48; 34/50; 34/155

[58] Field of Search ..... 354/299, 320, 321, 322; 34/44, 46, 48, 50, 155

[56] References Cited

U.S. PATENT DOCUMENTS

| | | | |
|---|---|---|---|
| 4,914,835 | 4/1990 | Kose et al. | 354/299 X |
| 4,952,960 | 8/1990 | Kosugi et al. | 354/299 |

*Primary Examiner*—A. A. Mathews

*Attorney, Agent, or Firm*—Frishauf, Holtz, Goodman & Woodward

[57] ABSTRACT

In an automatic developing machine in which a photographic film is dried by a drying unit after development, a method of controlling the temperature and/or humidity of the film drying air in order to prevent variation in the film size before and after the processes of development and drying, which comprises prior computation of the variations in the film size according to a temperature and humidity of outside air, thereby determining the optimum operating condition of the drying unit from a result of the prior computation, and thereafter setting the drying unit with the optimum operating condition so that the automatic developing machine may process the film without variation in the film size.

24 Claims, 5 Drawing Sheets

DRYING AIR CONTROL METHOD IN AN AUTOMATIC DEVELOPING MACHINE AND AN AUTOMATIC DEVELOPING MACHINE EMPLOYING THE METHOD

This is a continuation of application Ser. No. 07/329,419, filed on Mar. 27, 1989, now U.S. Pat. No. 4,952,960.

BACKGROUND OF THE INVENTION

The field of art to which the present invention pertains relates to a drying air control method in an automatic developing machine and to an automatic developing machine employing the method, to develop silver halide photosensitive materials. To describe in more detail, the invention relates to an optimum drying air control method and a developing machine employing the method which develops original color films consisting of three or four plates used in multicolor printing.

The prior art to which the invention is directed is explained as follows.

A conventional silver halide photosensitive material which will be called a film in this specification hereafter has the characteristic that it shrinks when the humidity is low and expands when it is high. Apart from shrinkage and expansion of a film according to the humidity, a film has the characteristic that the size of a film varies before and after being processed. This means that the size of a film and the image size on the film which is equal to the size of the original plate may be different from the size of a processed film and that of the image on it. The variation in size is influenced by the temperature and humidity when the film is exposed and also when it is dried after being processed. In the latter case, the size of an original plate differs from that of a duplicated film. As a result, it causes problems which are described as follows.

Originals for multicolor printing consist of three original plates which are cyan, magenta and yellow, or four original plates wherein black is added to those three colors. Films on the market for use as original films for multicolor printing have the above-mentioned characteristic with regard to temperature and humidity, so variation in film size before and after development is caused by variations of temperature and humidity during the exposure process and the drying process, and can be a problem in many cases. That is the reason why stability of film size is required in a set of original films.

For instance, in the case that a film exposed as a cyan plate is used as an original film, the picture position of a magenta plate is adjusted to it, and when exposure and development operations are conducted, a gap is created between the magenta plate and cyan plate.

In the case of conventional automatic developing machines, several methods to control drying air are publicly known, such as changing the recycling ratio of drying air, which means the ratio of the dry air recycling in the drying unit to the new air introduced from the outside into the unit, setting temperature gradient from the exit to the entrance of the drying unit, dehumidifying the air to be used for drying and the like. But the objectives of these methods are to increase efficiency of air drying, to save labor, to save energy to prevent uneveness of air drying, and so forth. Stability of film size has never been taken into consideration as far as these methods are concerned.

Accordingly, it is the object of the present invention to take countermeasures against these problems.

The problems to be solved by the invention are described as follows.

(A) With respect to the method of changing the recycling air ratio in accordance with the outside air humidity, it is difficult to unify the humidity of the air inside the drying unit without the influence of the humidity of the outside air, so it is impossible to control film size stability before and after processing.

(B) The method of setting a temperature gradient is useful for increasing drying efficiency, but fluctuations in temperature and humidity are so big that the result is not good as far as film size stability is concerned.

(C) The conventional method has a further shortcoming in that the film size stability of the first film differs from that of the last one because of change in the drying conditions due to evaporation of water from films.

SUMMARY OF THE INVENTION

It is a main object of the invention to provide an improved air drying control system and an automatic developing machine that stabilizes film size before and after processing by establishing the optimum air drying condition according to the relation between the outside air humidity, while the film is exposed and the characteristics of the film in terms of size change caused by the humidity of the air around it. Many other features, advantages and additional objects of the present invention will become manifest to those versed in the art upon making reference to the detailed description which follows and the accompanying sheets of drawings.

The features of the air drying system in an automatic developing machine of the present invention are as follows.

The variation of film size before and after processing is calculated in advance according to the temperature and humidity of the outside air. The optimum temperature and humidity of the drying air of the air drying unit are calculated according to the information concerning the change of film size. Then the temperature and humidity of the air drying unit are controlled according to the results obtained by the calculation, and films are dried in the drying unit which is controlled in this way. The change of film size is controlled by the method mentioned above. The characteristics of the automatic developing machine of the present invention will be described as follows.

The automatic developing machine has a first calculating means by which the change of film size before and after the drying process is calculated before drying the film according to the outside air temperature and humidity, a second calculating means by which the optimum temperature and humidity of the drying unit are calculated according to the results of the calculation of the first calculating means, and control means whereby the change of film size is controlled by controlling the temperature and/or humidity of the drying unit according to the results of the calculation by the second calculating means.

Summary of the invention will be described as follows.

(1) The relation between the outside air temperature, the outside air humidity, the temperature of the drying unit, and the humidity of the drying unit and the change of film size after being processed, is calculated by the formula [1] described below.

$$\Delta l_1 = A + \alpha_0(t_0 - t_{s0}) - \beta_0(h_0 - h_{s0}) + \alpha_D(t_D - t_s) - \beta_D \cdot (h_D - h_s) \quad \text{Formula [1]}$$

$\Delta l_1$: the change of film size (%)
$t_0$: the temperature of the outside air (° C.)
$t_D$: the drying temperature (° C.)
$t_s$: the standard drying temperature (° C.)
$t_{s0}$: the standard temperature of the outside air (° C.)
$h_0$: the humidity of the outside air (g/kg)
$h_D$: the drying humidity (g/kg)
$h_s$: the standard drying humidity (g/kg)
$h_{s0}$: the standard humidity of the outside air (g/kg)
A, $\alpha_0$, $\beta_0$, $\alpha_D$, $\beta_D$ are the constants which are to be determined by the kinds of films to be processed and the structure of the drying unit.

(2) The first calculating means described above is adopted as the first memory means.

(3) The second calculating means described above is adopted as the second memory means.

DETAILED DESCRIPTION OF THE EMBODIMENTS

The objects of the invention will become more apparent in the detailed description and examples which follow.

Figure 1:
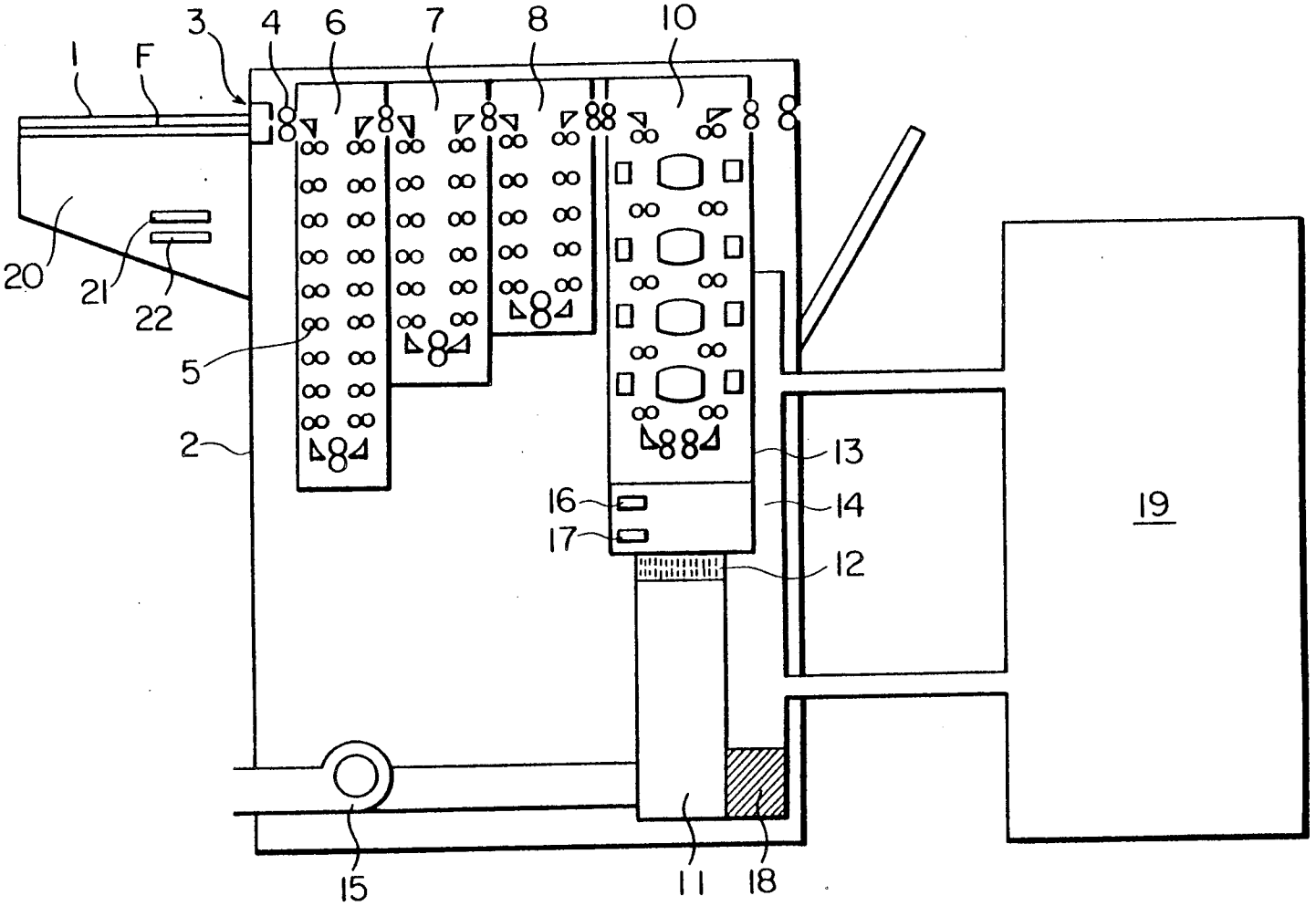
FIG. 1 is a schematic illustration of one of the automatic developing machines of the present invention.

Referring first to the embodiment of the invention shown in FIG. 1, the mark F designates a film to be processed which is set in a magazine for example and placed at the insertion unit 3 which is mounted on the side of the apparatus frame 2.

After the magazine 1 is set and the start button, which is not shown in the drawing, is pressed, the existence of the film to be processed is detected by a detector not shown in the drawing. After that, the film is pulled out by a pair of rollers, which are not shown in the drawing, and pinched by the film drawing rollers 4. Thereafter, the film is conveyed to the developing tank 6, the fixing tank 7, and washing tank 8, being guided by a group of conveying rollers 5. While the film is passing through these tanks, it is processed.

After being washed in the washing tank, the film is guided to the squeegeeing unit to be wiped. Thereafter, the film is led to the drying unit 10, dried, and discharged from the apparatus through the film delivery port.

The numeral 11 is a drying fan, the numeral 12 is a heater, the numeral 13 is a drying rack, the numeral 14 is a drying duct, and the numeral 15 is an exhaust fan.

The numeral 16 represents a humidity sensor and the numeral 17 represents a temperature sensor. It is preferable that both sensors are installed close to the delivery port of drying air, but they can also be mounted in another drying air circulating route.

Figure 2:
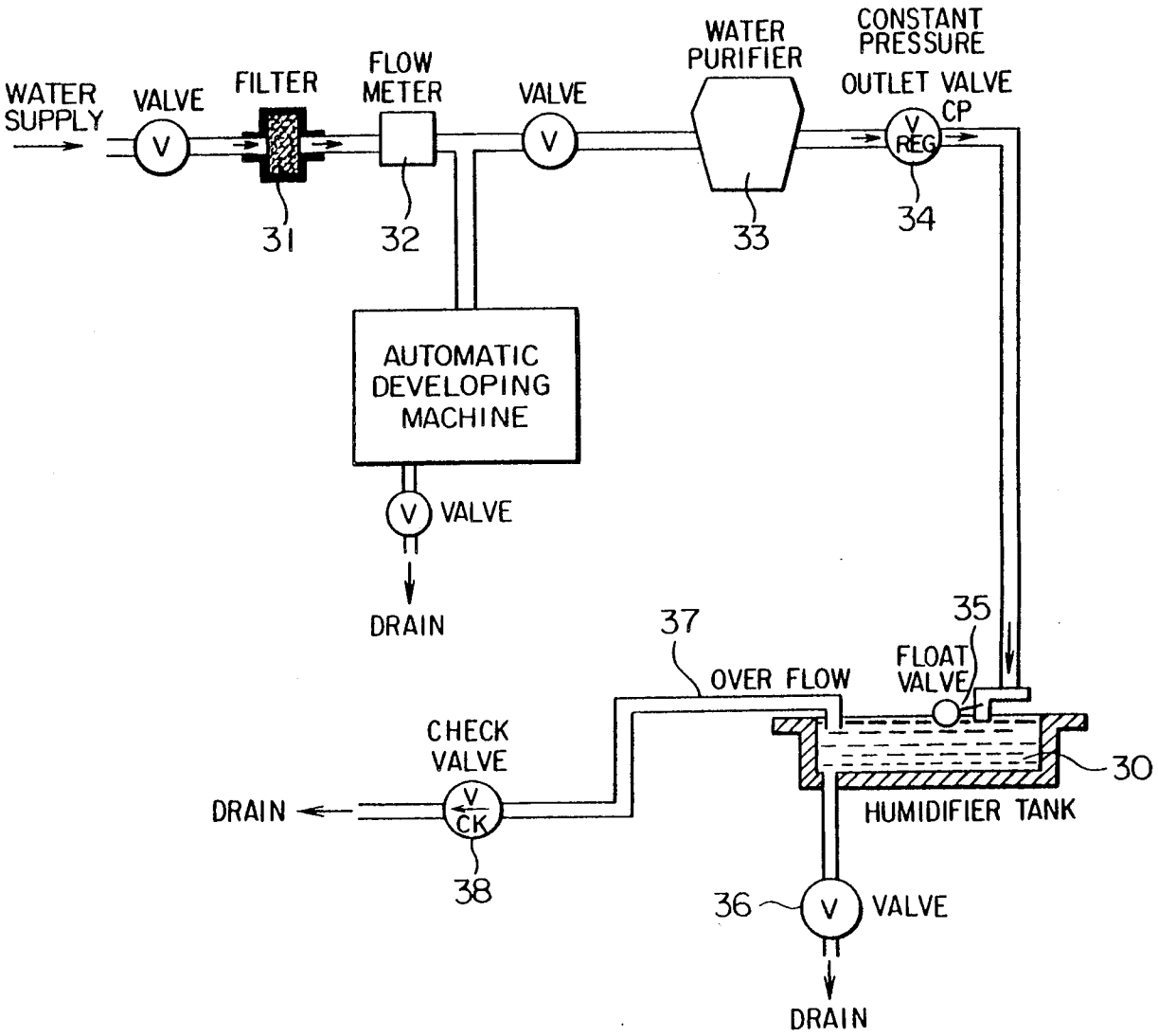
FIG. 2 is a schematic illustration of one of the humidifiers.

The numeral 18 represents a humidifier, which is usually installed close to the exhaust port of the drying fan 11, but it can be mounted in another drying air circulation route or at the position close to the intake for outside air. The structure of this humidifier is not limited to one type, but it can be one of the various types of humidifiers which are publicly known. For instance, it can be the humidifier as shown in FIG. 2 that evaporates water in the tank 30 with a heater or it can be an ultrasonic humidifier. In FIG. 2, the numeral 31 is a filter, the numeral 32 is a flow meter, the numeral 33 is a water purifier, the numeral 34 is a constant flow valve, the numeral 35 is a float valve, the numeral 36 is a drain valve, the numeral 37 is an overflow unit, and the numeral 38 is a check valve. Water is supplied to the unit by the branch pipe connected with the water supply pipe to the automatic developing machine.

The numeral 19 represents a dehumidifier which is connected with the drying air duct 14 by a pair of tubes. It dehumidifies drying air.

The numeral 20 is a control unit with CPU. CPU represents the central processing unit. The drying air fan 11, the heater 12, the exhaust fan 15, the humidifier 18, and the dehumidifier 19 are controlled by CPU. As a result, the temperature and/or humidity of the drying unit 10 are controlled. Various kinds of control means such as ON-OFF control, Proportional Control, PID control and so on which are publicly known, can be applied to the control unit 20.

CPU has the first calculating means and the second calculating means. By the first calculating means, CPU calculates the change of the size of film F before and after the drying process in advance using the outside air temperature detected by the temperature sensor 22 and the outside air humidity detected by the humidity sensor 21. By the second calculating means, the optimum temperature and humidity of the drying unit are calculated according to the information obtained by the first calculating means. The data obtained by the second calculating means is transmitted to the control unit 20, and the control unit controls the temperature and/or humidity of the drying unit 10 to control the change of the size of film F. It is preferable that the first and second calculating means have memory means respectively in order to calculate rapidly to get the optimum control data under various conditions.

Figure 3:
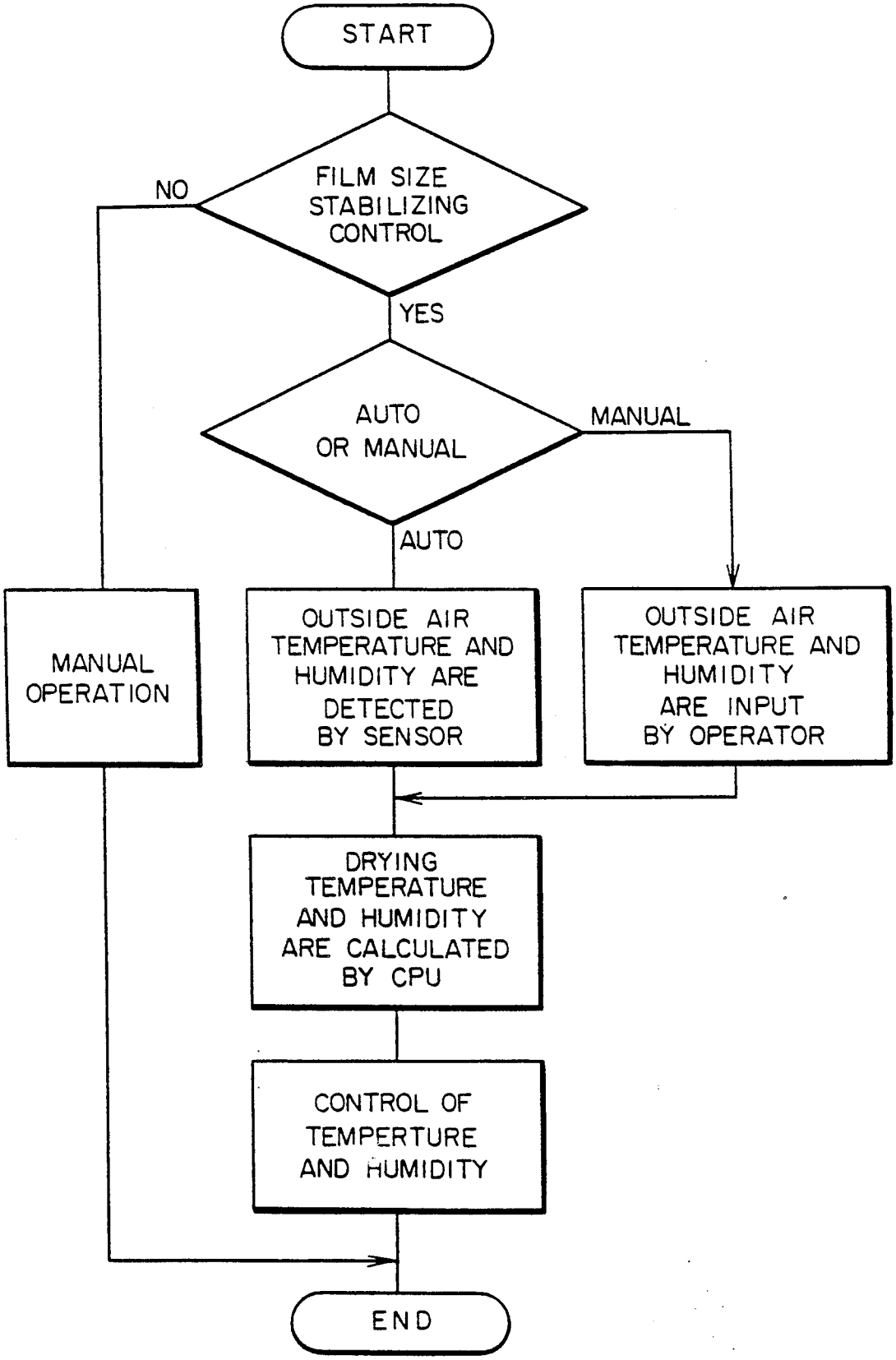
FIG. 3 is a flow chart which shows one of the examples of the drying unit control by CPU.

Control of the drying unit 10 by CPU is conducted as shown on the flow chart in FIG. 3 for example.

First of all, an operator selects 'Yes' or 'No' with regard to film size stability control. If the operator selects 'No', the drying control is conducted in the same way as the conventional method.

In the case that the operator selects 'Yes', he must select one out of two cases.

Case 1 is an automatic mode in which everything, such as detecting the outside air temperature and humidity and controlling the temperature and humidity of the drying unit 10 is controlled by CPU.

Case 2 is a manual mode in which every value, for instance the outside air temperature and humidity, is set by the operator with the manual operating unit 230 shown in FIG. 1, and the temperature and humidity of the drying unit 10 are controlled by CPU according to the input information.

In Case 1, the drying temperature and/or humidity are controlled as follows.

(a) The outside air humidity sensor 21 and temperature sensor 22 detect the outside humidity and temperature.

(b) CPU calculates and determines the temperature and/or humidity of the drying unit 10 according to the outside air humidity and temperature detected.

(c) The control unit controls the humidity and/or temperature of drying air according to the results of calculation by CPU.

(d) The film is dried.

In Case 2, the drying temperature and/or humidity are controlled as follows.

(a) The humidity and temperature are measured by an operator at the place where the film is exposed and the operator inputs the measured values to the operating unit.

Processes from (b) to (d) are the same as those of Case 1.

In FIG. 3, the conventional drying method in which film size Stabilizing control is not conducted is illustrated, too, but it can be omitted from the control system.

In the case that the temperature and humidity of the drying unit 10 are controlled, higher accuracy can be obtained by feeding back the data to CPU, in this case the data means the drying air temperature and humidity detected.

Figure 4:
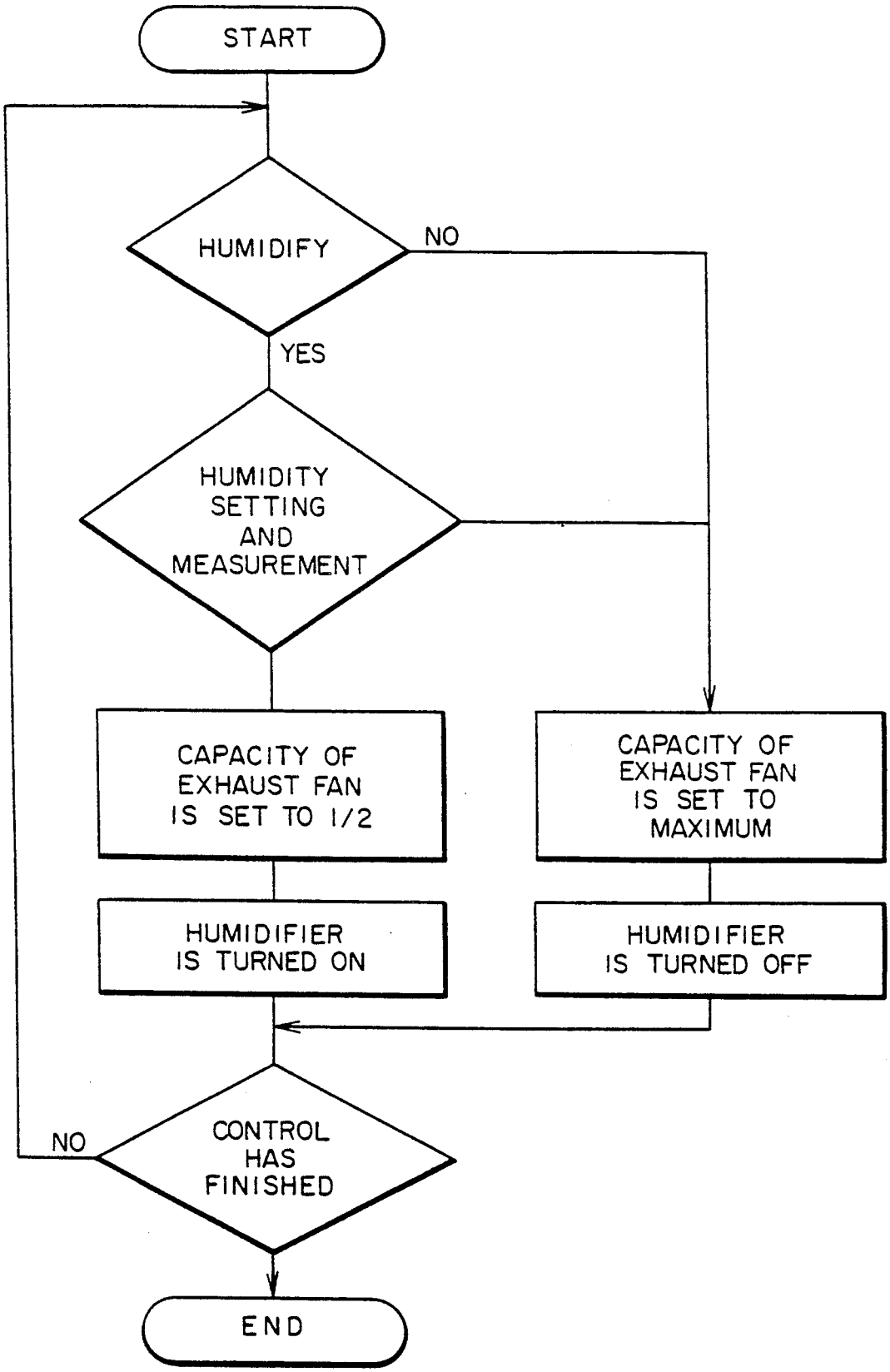
FIG. 4 is a flow chart which shows one of the examples of drying air temperature control.

Referring to FIG. 4, when the humidity of the drying unit 10 is controlled, in the case that the drying air is not humidified, the air quantity of the exhaust fan 15 is maximized for the humidity so as not to enter the drying unit 10. In the case that the drying air is humidified, the air quantity of the exhausting fan is reduced to a half of its capacity. In this way, the humidity increasing speed and the speed to attain the maximum humidity can be doubled comparing with the case that the air quantity of the exhausting fan is not controlled.

It is preferable that the manual operating unit used to input data manually is installed close to the other operating unit or in the same panel. The reason is that processes such as color development, bleaching, fixing, stabilizing, washing, and so forth except drying are connected with each other, and maneuverability of the automatic developing machine may be increased. It is preferable that the input data and calculated data are displayed in the operating unit.

In this embodiment, the outside air humidity sensor 21 and temperature sensor 22 are installed in the automatic developing machine. But, when the environmental conditions, such as the temperature and humidity, around the exposing machine, are different from those of the automatic developing machine, it is preferable that the additional humidity sensor 21 and the additional temperature sensor 22 are installed close to the exposing machine. In this case, the drying air temperature and humidity should be determined taking into consideration the humidity information detected by the humidity sensor close to the exposing machine.

The temperature sensor and humidity sensor which are mounted on the automatic developing machine are used to get data about the intake air to control the temperature and humidity of drying air, but they are not necessarily essential, so they can be omitted.

One of the examples of calculating means used in CPU will be explained as follows. In other words, a formula which represents the relation between the change of film size and factors such as the outside air temperature, the outside air humidity, the drying unit temperature and drying unit humidity, will be described below.

The inventors investigated the relation between the change of film size and the outside air temperature and humidity, and the drying unit temperature and humidity under various conditions. They discovered that the change of film size can be expressed approximately by the formula [1] under certain conditions.

$$\Delta l_1 = A + \alpha_0(t_0 - t_{s0}) - \beta_0(h_0 - h_{s0}) + \alpha_D(t_D - t_s) - \beta_D(h_D - h_s) \quad \text{Formula [1]}$$

$\Delta l_1$: the change of film (%)
$t_0$: the outside air temperature (° C.)
$t_D$: the drying temperature (° C.)
$t_s$: the standard drying temperature (° C.)
$h_0$: the outside humidity (g/kg)
$h_D$: the drying humidity (g/kg)
$h_s$: the standard drying humidity (g/kg) almost equal to the outside humidity
$t_{s0}$: the standard outside temperature (° C.)
$h_{s0}$: the standard outside humidity (g/kg)
A, $\alpha_0$, $B_0$, $\alpha_D$, $\beta_D$ are constants which are determined by size variations characteristics the kind of film and the structure of the drying unit.

The first half of the formula $A + \alpha_0(t_0 - t_{s0}) - \beta_0 h_0 - h_{s0})$, which will be called Formula [1a] hereafter, is the formula that calculates the change of film size before the drying process in the case that the humidity of the drying air is not controlled. The latter half of the formula $\alpha_D(t_D - t_s) - \beta_D(h_D - h_s)$, which will be called Formula [1b] hereafter, is the formula that calculates the change of film size in advance before the drying process in the case that the drying temperature $t_D$ and/or the humidity $h_D$ are changed.

Accordingly, if the result of the calculation is zero, the calculation means that the amount of the change of film size calculated by Formula [1b] is deducted from the amount of the change of film size calculated by Formula [1a], it means the change of film size is zero. If the drying temperature $t_D$ and/or the humidity $h_D$ are set in advance so as to obtain the result described above, changes in film size can be reduced.

In the case that the result of the calculation by Formula [1] is to be set to an optional value, for instance, in such a case in which the size variation characteristics of the original plates differ from each other, or the result of the calculation is desired to be different from what it is supposed to be even if the size variation characteristics are all the same, the drying temperature $t_D$ and/or the humidity $h_D$ can be controlled to be optimum values by setting $\Delta l_1$ to an optional value.

The standard drying temperature $t_s$ is set to from 30° C. to 70° C. in the conventional automatic developing machine. The temperature is usually set to from 30° C. to 60° C. for printing and plate making. So, it is preferable to set the standard drying temperature $t_s$ to a value in the range from 0° C. to 70° C. It is more preferable to set the temperature to a value in the range from 30° C. to 60° C.

In the present invention, the preferable ranges of the outside temperature and humidity are as follows.

(1) Relative humidity: from 5% to 90% under the conditions wherein the outside temperature is from 5° C. to 35° C. and the outside humidity is from 1.5 g/kg to 25 g/kg (2) The preferable conditions are as follows.

Relative humidity: from 10% to 80% under the conditions wherein the outside temperature is from 5° C. to 30° C. the outside humidity is from 1.5 g/kg to 20 g/kg (3) The more preferable conditions are as follows.

Relative humidity: from 10% to 70% under the conditions wherein the outside temperature is from 5° C. to 30° C. the outside humidity is from 1.5 g/kg to 17 g/kg The outside air relative humidity has a constant relation with the outside air temperature and humidity. It can be calculated by a publicly known formula or a humid air diagram.

It can be seen from the above that it is most preferable for the operating conditions to be chosen from these ranges.

The outside temperature: from 5° C. to 30° C.
The outside humidity: from 1.5 g/kg to 17 g/kg
The relative humidity: from 10% to 70%

The outside humidity can be used as the standard drying humidity. The drying unit humidity of the automatic developing machine, the drying temperature which is set to the standard drying temperature, can be used as the standard drying humidity.

The ranges of the constants, $\alpha_0$, $\beta_0$, $\alpha_D$, and $A_0$ are as follows. $\alpha_0$:

$+1.3\times10^{-3}--1.3\times10-3$ (%/° C.)

more precise values $+7\times10^{-4}--7\times10-4$ (%/° C.)

the most precise values $+4\times10^{-4}--4\times10-4$ (%/° C.)

$\beta_0$:

$5\times10^{-4}-5\times10-3$ (%/g/kg)

more precise values $7\times10^{-4}-2.2\times10-3$ (%/g/kg)

the most precise values $1.0\times10^{-3}-1.8\times10-3$ (%/g/kg)

$\alpha_D$:

$8.9\times10^{-5}-7.2\times10-4$ (%/° C.)

more precise values $1.7\times10^{-4}-3.6\times10-4$ (%/° C.)

$\beta_D$:

$1.7\times10^{-4}-1.3\times10-3$ (%/g/kg)

more precise values $2.6\times10^{-4}-5.4\times10-4$ (%/g/kg)

A:

the outside air standard temperature. 23° C.
the outside air standard humidity. 11 g/kg
the standard drying temperature. 45° C.
the standard drying humidity. 11 g/kg Under the conditions described above, the range of the value of A is $-2.0\times10^{-3}-+2.0\times10-3$.

The value of A is equal to the change of film size before and after processing in the case in which the film is exposed and developed under the same conditions as the outside air standard temperature, humidity, the standard drying temperature and humidity. Therefore, the value of A varies according to the outside air standard temperature, the outside air humidity, the standard drying temperature, and the standard drying humidity. The change of the value A can be calculated by Formula [1].

The operating conditions are decided by choosing the optimum values from the range described above and assigning the values to Formula [1].

In case the results of calculation of Formula [1a] are positive, and the film size expands in the drying process, the drying humidity $h_D$ of Formula [1b] is not changed but the drying temperature $t_D$ is changed in order to avoid film size fluctuation.

In the case the results of calculation of Formula [1a] are negative, and the film shrinks during the drying process, the drying temperature $t_D$ of Formula [1b] is not changed but the drying humidity $h_D$ is changed in order to avoid film size fluctuation.

In the method described above, either, the drying temperature $t_D$, or the drying humidity $h_D$, is adjusted. If a change in film size can not be avoided by adjusting one of them, it can be avoided by adjusting both of them.

Needless to say, the calculation by Formula [1] is conducted by CPU not only in auto mode but also in manual mode.

The main embodiment of the present invention was described above. More details of the invention will be explained below.

The present invention includes the following points.

[1] The outside temperature and humidity to be detected should be the temperature and humidity of the environmental air in which a film is exposed.

[2] The automatic developing machine should have a means to detect the drying air temperature and humidity.

[3] A means to detect the temperature and/or humidity of the outside air is omitted.

[4] The information of either the drying air temperature or the humidity is input to the machine by an operator, and the other is controlled automatically.

[5] The information about the outside air humidity is obtained by the information about the drying air humidity.

[6] The information about the temperature and/or humidity of the outside air is input to the machine by an operator.

[7] Both the drying air temperature and humidity are input by an operator and the drying air is controlled according to the set point.

Referring to FIG. 1, there is shown therein an example of the present invention. The details of the invention will be seen by reference to the description below in connection with the accompanying drawing.

The structure of the machine was described before with the exception of the sensors. The numeral 20 represents the control section equipped with the outside humidity sensor 21 and the outside temperature sensor 22.

Although the outside temperature and humidity sensors are installed in the automatic developing machine in this embodiment, it is preferable to install the temperature and humidity sensors at a position close to the exposure apparatus in case the environmental temperature and humidity of the developing machine should differ from those of the exposure apparatus.

In this case, the drying air temperature and humidity are determined according to the information collected by the temperature sensor 221 and humidity sensor 222 mounted remotely at a position close to the exposure apparatus. The outside air temperature sensor and humidity sensor installed in the automatic developing machine are used to collect the information about the temperature and humidity of the air taken in from outside to be utilized as the drying air, but the outside temperature sensor and humidity sensor can be omitted in this case.

The matters of the invention [2], [3], [4], [5], [6], and [7] mentioned above will be described as follows.

[2]

When the drying air temperature and humidity are controlled, its temperature and humidity are detected and the obtained information is fed back to the computer for control. Control precision can be increased by this operation.

[3], [5], and [6]

a. When a film is not being processed, and therefore the drying air temperature and humidity are not being controlled, the absolute humidity of the drying air is equal to that of the outside air. Since the drying air consists of circulating air and air taken in from outside, the above-mentioned matter can be seen in the steady state, wherein humidifying, dehumidifying, and film processing are not conducted at all. Therefore, the outside air relative humidity can be computed by a publicly known formula using the drying air humidity and temperature in the steady state and the information about the outside air temperature. Using this method, the outside humidity sensor becomes unnecessary and costs can be cut.

b. The steady state condition.

The time to be required to reach the steady state after films were processed is explained as follows.

After a film is discharged from the drying unit, control of the temperature and humidity of the drying air stops. After an interval of some time, the drying air becomes the steady state, wherein the absolute temperature of the drying air is equal to that of the outside air. The interval differs according to conditions. The conditions are (a) the quantity of air taken in from outside, (b) the volume in which the drying air circulates, (c) the difference between the absolute humidity of the drying air and that of the outside air.

One of the examples of the invention is shown as follows.

Volume of air taken in from outside: 2.0 $m^3$/min
Volume of air circulating section: 0.15 $m^3$ When the difference between the absolute humidity of the outside air and that of the drying air was 20 g/kg, it took 15 seconds to reach the steady state after a film was processed.

It is preferable that computation is conducted to calculate the outside humidity according to the absolute humidity of the drying unit after a fixed interval, in the case of this machine it is more than 15 seconds.

[4]

a. It is preferable that the film is dried completely after it is discharged from the drying unit. Although the drying temperature and humidity control is conducted according to the size change characteristic of the film, it is preferable that the drying air temperature and humidity control be conducted within the film drying capacity to dry water absorbed by the film so that it may be dried perfectly to dry a film perfectly. This can be seen in the case of [2], [3], [5], and [6] as well as [4].

In some cases, even if the information about the water absorption the film is input to the computer beforehand, the quantity of water absorbed by film changes according to the kind of film, the production lot even though the kind of film is the same, and the fatigued conditions of developing, fixing, and washing solutions. Because of the variability in the water absorption of film, sometimes films are not dried completely. In this case, an operator observes the drying conditions of a film and may adjust the setting point of the drying temperature and humidity in order to avoid faulty drying of film.

In this method, it is preferable that the computer works automatically to adjust the setting according to the characteristic of variation of film size, in accordance with the setting change by the operator.

b. In that case that there is a difference between the temperature and humidity conditions when a film is exposed and those detected by this automatic developing machine, it may be caused by:

(1) A time difference between exposure and film processing.

(2) Exposure and film processing are conducted in different places.

(3) Conditions fluctuate according to draughts in the same room.

When the film characteristic is different from that input to the machine beforehand in view of the data of film size variation, it may be caused by:

(1) Dispersion owing to the producing lot (2) A film change, and so on.

In the case that an operator wants to change the size of film before and after processing for a special purpose, or in the case that the document sizes are different from one another among the four plates, fine adjustment can be applied. In this method, when the operator changes one setting point, it is preferable not to change other settings.

[7]

The environmental temperature and humidity around the automatic developing machine are measured by an operator. It is preferable to measure the temperature and humidity when a film is exposed. The operator sets the drying air temperature and humidity conditions to the machine in accordance with the film size variation characteristics. The environmental temperature and humidity can be converted to the drying air temperature and humidity automatically by the automatic developing machine, or the operator can do it manually using the data list about the film size variation characteristics.

EXAMPLES

The invention may be understood more readily with reference to the following examples. However these examples are intended to illustrate the invention and are not to be so construed as to limit the scope of the invention.

The experimental data shown here was obtained by experiments using the treatment agents described below and the automatic developing machine illustrated in FIG. 1.

Silver halide emulsion was made by adding silver nitrate solution, sodium chloride, and potassium bromide solution to a gelatin solution at the same time. After the emulsion was sulphur-sensitized with the ordinary method, formaldehyde was added to the emulsion as the hardening agent. The coating emulsion was made in this way. As the backing layer, on the opposite side of the emulsion layer, the mixture used consists of gelatin and latex, and the mixing ratio was 2:1.

The coating and drying process will be explained as follows.

It was coated on a polyethylene terephthalate film which had a latex undercoating, the thickness of film was 100 μm, with the quantity of gelatin of 2 g/$m^2$. At the same time, the protecting emulsion layer was coated on the outside of the emulsion layer with quantity of gelatin of 1g/m$^2$. This film was dried by the drying method which will be described later.

The above-mentioned coating emulsion was coated on the opposite side of the backing side where the backing layer was already coated and dried. The quantity of gelatin should be controlled to be 2 g/m$^2$ when the emulsion was coated. At this moment, the emulsion was coated on the emulsion protecting layer at a quantity of gelatin of 1 g/m$^2$.

This film was dried by the drying method which will be explained later. The sample was made in this way. In this case, the quantity of silver coated on the film was 3.5 g/m$^2$.

Drying conditions during coating

After the coating agent, at a temperature of 35° C., is coated, cold air, at a temperature of 5° C., is blown for 6 seconds to cause coagulation. After that, the coated layer is dried with the drying air, the dry bulb temperature of which is 23° C. and the relative humidity of which is 20%, the temperature of the coating surface is 10° C. Drying operation was continued until the moisture content of the coated gelatin layer became 1,600%. Then it was dried with the drying air, the drying temperature of which was 27° C. and the relative humidity of which was 20%. After that, it was dried by the drying air, the temperature of which was 34° C. and the relative humidity of which was 43% until the average temperature of the coated surface became 33° C. After 5 seconds, it was dried for 40 seconds by the drying air, the dry bulb temperature of which was 45° C. and the relative humidity of which was 22%. After the coating and drying process, the sample film was wound up in the air, the dew point of which was 6° C., and stored.

This sample was cut to 30 cm×60 cm, and two fine lines were exposed to the light with the P-627FM Room Light Printer which was manufactured by Dainippon Screen Co. to make an image of fine lines on the sample at an interval of about 56 cm. The document used in the experiment was made in this way.

This document, and the unexposed sample which is the same as the document, the printer, and the automatic developing machine were completely humidified at 25° C. on each humidity condition. After that, the unexposed sample was set on the document and exposed to make a contact print. Then the sample was developed by the automatic developing machine. The developed sample was placed upon the original document and the distance between the two fine lines on the sample was compared with those of the document in order to find the change of distance, using a magnifying glass with a scale.

The optimum drying condition at each outside air temperature and humidity in terms of stability of film size, should be determined independently according to each film, so the air drying conditions are not restricted to those shown in this embodiment.

The number of samples on which this measurement was conducted was six and collected data was averaged. The average error was ±10 μm.

The operating conditions of the automatic developing machine are as follows.

The GR-27 Automatic Developing Machine manufactured by Konica Co. was modified. The drying unit and humidifying unit US-04 BM manufactured by Mikuni Kogyo Co. were installed in the automatic developing machine. The temperature and humidity sensors for the drying unit and the outside air were also installed in the machine. The processing conditions and the compositions of the agents are described below.

| Processing Condition | | |
|---|---|---|
| Development | 30 sec. | 38° C. |
| Fixing | 20 sec. | 28° C. |
| Washing | 15 sec. | |
| Drying | 23 sec. | |

| Composition of Developer | |
|---|---|
| [Composition A] | |
| Pure Water (Ion Exchange Water) | 150 ml |
| Sodium ethylenediaminetetraacetate | 2 g |
| Diethylene glycol | 50 g |
| Potassium salfite (55% w/v solution) | 100 ml |
| Potassium carbonate | 50 g |
| Hydroquinone | 15 g |
| 5-Methylbenztriazol | 200 mg |
| 1-Phenyl-5-mercapto tetrazole | 30 mg |
| Potassium hydroxide pH = 10.9 after used | |
| Potassium bromide | 4.5 g |
| [Composition B] | |
| Pure water (Ion Exchange Water) | 3 mg |
| Diethylene glycol | 50 g |
| Disodium ethylene diaminetetraacetate | 25 g |
| Acetic acid (90% solution) | 0.3 ml |
| 5-Nitroindazole | 110 mg |
| 1-phenyl-5-mercapto-tetrazole | 500 mg |

For the developer, composition A was dissolved in 500 ml water and then composition B was dissolved in it. Then water was added so that the quantity of the developer was made up to be 1 liter.

| Composition of Fixing Solution | |
|---|---|
| [Composition A] | |
| Ammonium thiosulfate (72.5% w/v solution) | 230 ml |
| Sodium sulfite | 9.5 g |
| Sodium acetate | 15.9 g |
| Boric acid | 6.7 g |
| Sodium citrate di-hydrate | 2 g |
| Acetic acid (90% w/w solution) | 8.1 ml |
| [Composition B] | |
| Pure water (Ion exchange water) | 17 ml |
| Sulfuric acid (50% w/w solution) | 5.8 g |
| Aluminum sulfate ($Al_2O_3$ equivalent 8.1% solution) | 26.5 g |

For the fixing solution, composition A was dissolved in 500 ml water and then composition B was dissolved into it. Water was added so as to make 1 liter.

The pH of this fixing solution was 4.3.

EXAMPLE 1

The above-mentioned automatic developing machine was used for an experiment. The conventional drying mode was adopted in which film size stabilizing control was not conducted. The sample size of film was the same as that described before, the size of which was 30 cm×60 cm. The sample film was set and sent longitudinally in the machine. The results were as follows. The expansion of the sample was $+1.5\times10^{-2}$%. The standard drying temperature $t_s$ was 45° C., the outside air temperature $t_0$ was 15° C., and the outside air humidity $h_0$ was 2 g/kg.

The mode was changed to the automatic drying mode and the test was conducted. The expansion of the sample was $+9\times10^{-4}$%. The expansion of the sample was reduced a great deal.

Constants A, $\alpha_0$, $\beta_0$, $\alpha_D$, and $\beta_D$ were determined according to the kind of film and the structure of the drying unit. The details are as follows. A was $1.5\times10^{-3}$, $\alpha_0$ was $-2\times10^{-4}$, $\beta_0$ was $1.4\times10^{-3}$, $\alpha_D$ was $4.5\times10^{-4}$, and $\beta_D$ was $6.2\times10^{-4}$. Those values were assigned to the Formula [1]. CPU conducted the calculation according to those constants so that the film expansion became zero. The control unit controlled the drying unit according to the calculation results of CPU. The sample film was dried in this way. In this case, the drying temperature $t_D$ which was displayed in the operating unit was equal to the standard drying temperature $t_s$ that was 45° C. But the drying humidity $h_D$ changed to 27.5 g/kg.

EXAMPLE 2

In this example, the outside air temperature $t_0$ set to 28° C. and the outside air humidity $h_0$ set to 18 g/kg. The other conditions were the same as those of Example 1. The experiment was made under conditions of the conventional drying mode. The result of the experiment was that the sample film shrank by $-7.3\times10^{-3}$%.

Then the drying mode was changed to the automatic mode and the sample was processed in the same way. The change of the sample was measured and the result was that the sample shrank by $-1.2\times10^{-3}$%. The shrinkage was reduced remarkably. In this experiment, the constants A, $\alpha_0$, $\beta_0$, $\alpha_D$, and $\beta_D$ were determined according to the kind of film and the drying unit structure. A was $1.5\times10^{-3}$, $\alpha_0$ was $-2\times10^{4}$, $\beta_0$ was $1.4\times10^{-3}$, $\alpha_D$ was $4.5\times10^{-4}$, and $\beta_D$ was $6.2\times10^{-4}$. Those values were assigned to Formula [1]. CPU conducted calculation input those values so that the change of film size became zero. The drying unit was operated by the control unit which was informed of the results of the calculation by CPU. The drying humidity $h_D$ displayed on the operation unit was 11 g/kg, which was the same with the standard drying humidity $h_s$. The value $h_s$ was actually the same value as the outside air humidity $h_0$. But the drying temperature $t_D$ changed to 60° C.

Advantages of the invention will be described as follows.

The drying air control method of the invention and the automatic developing machine with the method of the present invention, can stabilize the change of film size before and after the developing process by setting the optimum drying conditions to the machine which are obtained by investigating the relation between the size change characteristics of the film and the outside environmental humidity and temperature, wherein they are the environmental humidity and temperature when the film is exposed.

In the case that the size change characteristics of a set of original plates differ from one another or even if they are equal, an operator wants to change the plate size before and after process, it is possible for the operator to control the change of film size as he wants by the method of controlling the drying unit temperature and/or humidity by setting the desired values in the machine.

EXAMPLE 3

The data shown on Charts 1, 2, 3, and 4 were obtained from the experiment by applying the following samples and treatment agents to the automatic developing machine illustrated in FIG. 1.

A silver halide emulsion was made by adding silver nitrate solution, sodium chloride, and potassium bromide solution to gelatin solution at the same time. After the emulsion was sulphur-sensitized with the ordinary method, the emulsion was coated on a polyethylene terephthalate film which had a latex undercoating, the thickness of which was 100 μm and the quantity of gelatin contained in it was 2 g/m$^2$. At the same time, the protective emulsion layer was coated on the outside of the emulsion layer in which gelatin is contained 1 g/m$^2$. After that, the sample was dried. The quantity of silver coated on the film was 3.5 g/m$^2$.

This sample was cut to 30 cm×60 cm, and the image of two fine lines was exposed to the light with the room light printer manufactured by Dainippon Screen Co. to make images at an interval of about 56 cm on the sample. The sample used in the experiment was made by the method described above.

This document, and the unexposed sample which is the same size as that of the document, the printer, and the automatic developing machine were all completely humidified at 25 ° C. After the humidifying process, the unexposed sample was set on the document and exposed to make a contact print. Then the sample was developed by the automatic developing machine. The developed sample was put upon the original document and the distance between the two fine line images on the sample were compared with those on the document in order to find out the change of the distance between the images of the two fine lines using a magnifying glass with a scale. The change of the distance between the two fine lines was measured by the method described above.

The optimum drying condition at each temperature and humidity of the outside air in terms of film size stability, should be determined independently according to each film, and so the air drying conditions are not restricted to those shown in this embodiment.

In the experiment, the number of samples was six and the collected values were averaged. The average error was ±10 μm.

The operating conditions of the automatic developing machine and the compositions of the treatment agents will now be explained.

| Treating Condition | | |
|---|---|---|
| Development | 20 sec. | 38° C. |
| Fixing | 20 sec. | 38° C. |
| Washing | 14.5 sec. | |
| Drying | 23 sec. | |

| Composition of Developer | |
|---|---|
| [Composition A] | |
| Pure Water (Ion exchange water) | 150 ml |
| Sodium ethylenediaminetetraacetate | 2 g |
| Diethylene glycol | 50 g |
| Potassium sulfite (55% w/v solution) | 100 ml |
| Potassium carbonate | 50 g |
| Hydroquinone | 15 g |
| 1-Phenyl-5 mercapto tetrazole | 30 mg |
| Potassium hydroxide (The quantity should be determined so that the pH is 10.9 after used.) | |
| Potassium bromide | 4.5 g |
| [Composition B] | |
| Pure water (Ion exchange water) | 3 mg |
| Diethylene glycal | 50 g |
| Disodium ethylene diaminetetraacetate | 25 g |
| Acetic acid (90% solution) | 0.3 ml |
| 1-Phenyl-5-mercapto-tetrazole | 500 mg |
| Sodium 2-mercapto-benzimidazole-5-sulfonate | 50 mg |

For the developer, composition A was dissolved in 500 ml water and then composition B was dissolved into it. Finally water was added to it so that the total quantity of the developer became 1 liter.

| Composition of Fixing Solution | |
|---|---|
| [Composition A] | |
| Ammonium thiosulfate (72.5% w/v solution) | 230 ml |
| Sodium sulfite | 9.5 g |
| Sodium acetate | 15.9 g |
| Boric acid | 6.7 g |
| Sodium citrate di-hydrate | 2 g |
| Acetic acid (90% w/v solution) | 8.1 ml |
| [Composition B] | |
| Pure water (Ion exchange water) | 17 ml |
| Sulfuric acid (50% w/w solution) | 5.8 g |
| Aluminum sulfate ($Al_2O_2$ equivalent 8.1% solution) | 26.5 g |

When the fixing solution was used, the composition A was dissolved in 500 ml water and then the composition B was dissolved into it. Water was added to it so that the total quantity became 1 liter.

The pH of this fixing solution was 4.3. The first control mode is to change the temperature of the drying air corresponding to the outside air humidity, in other words, the environmental humidity. According to this method, in the case that the environmental humidity is low, the temperature of drying air should be kept low, in other words, the relative humidity is kept high, in order to restrict expansion of the film size in the drying process.

When the environmental humidity is high, the temperature of the drying air should be kept high, in other words, the relative humidity is kept low, in order to restrict shrinkage of the film size in the drying process.

TABLE 1

| | Absolute humidity of outside air (g/kg) | Relative humidity of outside air (%) | Temperature of drying air of A.D.M. (°C.) | Absolute humidity of drying air (g/kg) | Change of size before and after processing (μm) | The present Invention |
|---|---|---|---|---|---|---|
| $A_1$ | 3.5 | 16 | 40 | 3.5 | +65 | |
| | 10 | 50 | 40 | 10 | +22 | |
| | 16 | 80 | 40 | 16 | −25 | |
| $B_1$ | 3.5 | 18 | open air temperature | 3.5 | +7 | o |
| | 10 | 50 | 35 | 10 | +2 | o |
| | 16 | 80 | 51 | 16 | +1 | o |

Remark:
A.D.M. on the table indicates an automatic developing machine.

According to $A_1$ of Table 1, in the case that a film is dried by the drying air the temperature of which is kept constantly at 40° C. if outside air at a temperature of 25° C. is used as the drying air after being humidified, the absolute humidity of the drying air is equal to that of the outside air. As a result, a large size change occurs in the sample.

Generally speaking, it is required that the accuracy should be within ±20 μm in the color printing film, so the size changes from −25 μm to +65 μm shown on Table 1 are not preferable.

According to the results of the method (the first mode) of the present invention, which are shown on $B_1$ of Table 1, even if the outside air is taken in, excellent results in which size changes are in the range from 1 μm to 7 μm, can be obtained by adjusting the temperature of the drying air.

It can be seen on the following tables that the changes of sample size are measured when the temperature of samples becomes 25° C. the outside temperature.

The second mode of size control is to adjust the humidity of the drying air corresponding to the environmental humidity. According to this method, in the case the environmental humidity is low, the expansion of film can be restricted by humidifying the drying air and drying films in the condition of high relative humidity. In the case the environmental humidity is high, the shrinkage of film can be restricted by dehumidifying the drying air.

TABLE 2

| | Absolute humidity of outside air (g/kg) | Relative humidity of outside air (%) | Temperature of drying air of A.D.M. (°C.) | Absolute humidity of drying air (g/kg) | Change of size before and after processing (μm) | The present Invention |
|---|---|---|---|---|---|---|
| $A_1$ | 3.5 | 18 | 40 | 3.5 | +65 | |
| | 10 | 50 | 40 | 10 | +22 | |
| | 16 | 80 | 40 | 16 | −25 | |
| $B_1$ | 3.5 | 18 | 40 | 14 | +4 | o |
| | 10 | 50 | 40 | 11.5 | −1 | o |
| | 16 | 80 | 40 | 4.5 | −2 | o |
| $A_2$ | 3.5 | 18 | 45 | 3.5 | +76 | |
| | 10 | 50 | 45 | 10 | +34 | |
| | 16 | 80 | 45 | 16 | −12 | |
| $B_2$ | 3.5 | 18 | 45 | 18 | +5 | o |
| | 10 | 50 | 45 | 15 | +1 | o |
| | 16 | 80 | 45 | 6 | +1 | o |

Remark:
The abbreviation A.D.M. means automatic developing machine.

Comparing the data of $A_1$ with those of $A_2$ on Table 2, it is clear that simply raising the temperature of the drying air can not decrease the change of film size so as to be within tolerance under all environmental temperature and humidity conditions. But according to the data of $B_1$ and $B_2$ on Table 2, it is clear that the quantity of size change can be greatly reduced adjusting the absolute humidity of the drying air.

In the first mode mentioned above, in the case that the environmental humidity is low, enough air drying capacity can not be obtained by low temperature drying air. In the second mode, in the case that the environmental humidity is high, the drying air humidity can not be reduced enough in a short time since the capacity of a dehumidifier is limited. Therefore, the film shrinks and the shrinkage is not within tolerance sometimes. Both in the first mode and the second mode, the optimum air drying condition can be set in terms of stability of film size corresponding to a small variation of the environmental humidity. But in these two methods, either temperature or humidity is controlled, so some undesirable effects can take place, such as expansion extension or shrinkage of film and not fully dried films.

Accordingly, in the third mode of the invention, both drying temperature and humidity are adjusted corresponding to the environmental humidity.

The first method of the third mode is that the standard temperature is set in advance as shown on Table 3. When the environmental humidity is low, the expansion of film is restricted by drying in the high relative humidity condition using a humidifier. When the environmental humidity is high, the operation of the humidifier is stopped and the air drying temperature is raised to lower the relative humidity. Since film drying is conducted in this condition, the shrinkage of film is reduced.

When the drying air absolute humidity is going to be set with the standard temperature, in the case that the humidity is lower than the outside air humidity and a dehumidifier is not installed, it is preferable that the outside absolute humidity is set automatically as the drying air absolute humidity.

TABLE 3

| | Standard temperature (°C.) | Absolute humidity of outside air (g/kg) | Relative humidity of outside air (%) | Temperature of drying air of A.D.M. (°C.) | Absolute humidity of drying air (g/kg) | Change of size before and after processing (μm) | The present Invention |
|---|---|---|---|---|---|---|---|
| $A_1$ | — | 3.5 | 18 | 40 | 3.5 | +65 | |
| | — | 10 | 50 | 40 | 10 | +22 | |
| | — | 16 | 80 | 40 | 16 | −25 | |
| $B_4$ | 40 | 3.5 | 18 | 40 | 14 | +4 | o |
| | 40 | 10 | 50 | 40 | 11.5 | −1 | o |
| | 40 | 16 | 80 | 51 | 16 | +1 | o |
| $A_2$ | — | 3.5 | 18 | 45 | 3.5 | +76 | |
| | | 10 | 50 | 45 | 10 | +34 | |
| | | 16 | 80 | 45 | 16 | −12 | |
| $B_5$ | 40 | 3.5 | 18 | 45 | 18 | +4 | o |
| | 40 | 10 | 50 | 45 | 15 | +1 | o |
| | 40 | 16 | 80 | 51 | 16 (OFF) | ±0 | o |

Remark:
A.D.M. represents an automatic developing machine.

The second method of the third mode will be explained with Table 4 as follows. The standard temperature should be set in advance. In the case that the environmental humidity is low, the drying air temperature should be decreased and the film dried under high relative humidity circumstances. In the case that the environmental humidity is high, the drying air temperature should be increased and the film is dried under low relative humidity circumstances.

If the drying air temperature to be set exceeds the controllable range of the automatic developing machine, it is preferable that the optimum condition is selected within the controllable range of the automatic developing machine by changing the drying air humidity. In this explanation, the controllable range means the drying air temperature range which does not adversely affect photographic efficiency of a film.

If the drying air temperature which is set according to the standard humidity exceeds 60° C., it is preferable that the humidifier is automatically turned off, and that the drying air temperature is set so that the absolute humidity of the drying air is equal to that of the outside air.

TABLE 4

| Standard temperature (°C.) | Absolute humidity of outside air (g/kg) | Relative humidity of outside air (%) | Temperature of drying air of A.D.M. (°C.) | Absolute humidity of drying air (g/kg) | Change of size before and after processing (μm) | The present Invention |
|---|---|---|---|---|---|---|
| 13 | 3.5 | 18 | 39 | 13 | +5 | o |
| 13 | 10 | 50 | 42 | 13 | −1 | o |
| 13 | 16 | 80 | 51 | 14 (OFF) | ±0 | o |
| 18 | 3.5 | 18 | 45 | 18 | +4 | o |
| 18 | 10 | 50 | 49 | 18 | +1 | o |
| 18 | 16 | 80 | 51 | 16 (OFF) | −2 | o |

Remark:
A.D.M. represents an automatic developing machine.

The invention has been explained above. In the explanation, the outside air humidity is supposed to be that of the developing process. So, the explanation is effective when a film is developed right after exposure. If a long time has passed since the film was exposed, the development should be conducted under different conditions. If the temperature at the time when the film was exposed is quite different from the environmental conditions of the automatic developing machine, it is preferable that the temperature at the time when the film is exposed should be input to the developing machine by an operator in order to obtain the optimum drying condition instead of the environmental conditions around the developing machine.

The size change characteristic of film before and after the process is different according to the type of film, in other words, brands and manufacturers of films. Needless to say everything is controlled according to the film's characteristics in the invention.

Advantages of the invention will be shown from the following description.

As shown by the experimental data in Tables 1, 2, 3, and 4, it is possible that the film size is stable while it is processed by the developing machine according to the drying air control method of the invention, whatever the environmental conditions are. The invention is very effective, especially when film negatives for color printing are made.

EXAMPLE 4

Another embodiment of the invention will be described as follows referring to FIG. 5 and FIG. 6. Other features and advantages of the invention will be apparent from the following description taken in connection with the accompanying drawing.

As described before, the drying air controlling unit of the automatic developing machine of the invention is equipped with one of the following constructions described below. The drying air controlling unit is installed at the outlet of the air drying unit of the automatic developing machine.

(1) The construction of the temperature automatic control unit which can detect the outside air temperature and humidity, and can control automatically the temperature of the drying air according to the information detected.

(2) The construction of the automatic humidity control unit which can detect the outside air temperature and humidity and can control automatically the humidity of the drying air according to the information detected.

(3) The structure of the humidity and temperature control which can detect the outside air temperature and humidity and can control automatically the humidity and temperature of the drying air.

The air drying unit of the automatic developing machine of the invention is divided into two sections. One is the drying air entry side section the drying air of which has no connection with the automatic control for film size stability. The other is the drying air delivery side section the drying air of which is controlled automatically by one of those three structures described above.

The embodiment of the invention includes the following items.

(a) The outside air temperature and humidity to be detected are measured when the film is exposed.

(b) The drying unit has the means to detect the temperature and humidity of the drying air.

(c) The detecting means of the outside air temperature and/or humidity are omitted.

(d) The information of either the drying air temperature or the humidity is input to the machine by an operator, and the other is controlled automatically.

(e) The information about the outside air humidity is obtained by the information about the drying air humidity.

(f) The information about the temperature and/or humidity of the outside air is input to the machine by an operator.

In the present invention, the outside temperature and humidity are detected, including the case that one or both are input to the machine by an operator, and the drying unit operating condition is decided by the control unit with the detected temperature and humidity and the relationship between the temperature and the humidity and the film size variation characteristic.

In the invention, even if it is necessary to dry a film at a low temperature and high humidity in order to minimize the film size variation, the temperature and humidity of the automatic developing machine drying unit can be set independently of the outside drying air control unit.

In other words, film size variation can be minimized without deteriorating the capacity of the drying unit of the automatic developing machine. In this way, a defective drying film can be avoided and the length of the film path in the drying unit and the drying time can be reduced in comparison to the conventional method.

Compared with the case explained in FIG. 1, in which the temperature and the humidity of the whole drying air unit of the automatic developing machine are controlled, the volume of the drying air is smaller than that in this invention. So the capacity of the heater, the humidifier, and dehumidifier can be made smaller. As a result, the apparatus can be made compact and the manufacturing cost of the machine can be reduced. This may also be true when the drying air unit of the automatic developing machine is divided into two sections.

Figure 5:
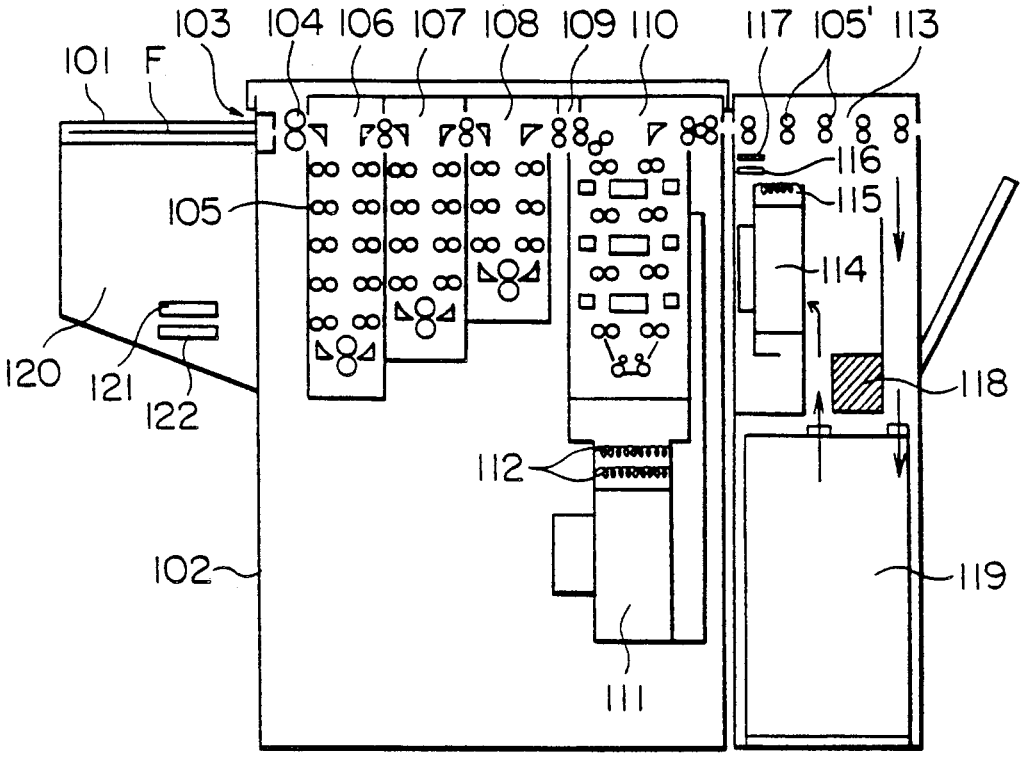
FIG. 5 is a schematic illustration of one of the automatic developing machines equipped with the air drying system of the invention.

A schematic illustration of a drying air unit of the invention is presented in FIG. 5. This drawing shows one of the examples in which the drying air unit is connected with an automatic developing machine. The film F to be treated is set in a magazine 101 for instance, and the magazine is mounted on the insertion unit 103 which is installed on the side frame 102 of the machine.

After the magazine 101 is set, the start button is pressed. Then the film to be treated is detected by the film detecting means and the film is pulled out by film pulling rollers. The film is drawn by film drawing rollers 104. After that the film is guided by a group of rollers 105 to the developing tank 106, the fixing tank 107, and the washing tank 108 to be treated. After the film has been washed, if necessary, the film is guided to the squeegeeing unit 109 in order to remove excess water, conveyed to the drying unit 110, and dried. After the drying process has been finished, the film is conveyed to the outside of the automatic developing machine from the outlet. The conventional drying unit structure. The numeral 111 in the drying unit 110 represents a fan and the numeral 112 represents a heater.

The drying air control unit 113 of the invention is connected with the outlet of the drying unit 110. In the drying air unit 113, the numeral 105' represents a group of conveying rollers, the numeral 114 represents a drying air fan, and the numeral 115 represents a heater.

The numeral 116 represents a humidity sensor for the drying air and the numeral 117 represents a temperature sensor. It is preferable that both sensors are installed close to the outlet of the drying air fan 114, but it can be mounted in the circulation path of drying air.

The numeral 118 represents a humidifier which is usually installed at the outlet of the drying air fan 114, but it can be also installed in the other drying air circulation path or close to the intake of the outside air.

The numeral 119 represents a dehumidifier to dehumidify the drying air.

The numeral 120 represents a control unit which is equipped with the humidity sensor 121 for the outside air and the temperature sensor 122 for the outside air.

In this embodiment, the temperature sensor and humidity sensor for the outside air are installed in the automatic developing machine. But it is preferable that the temperature sensor and humidity sensor for the outside air are also installed close to the exposure unit in case the exposure unit is set under a different environmental condition from that of the developing machine.

In this case, the temperature and humidity of the drying air are decided according to the information sent from the temperature and humidity sensors installed close to the exposure unit.

The temperature sensor and humidity sensor for the outside air which are installed on the automatic developing machine are used to get the information about the air that is taken in for use as the drying air. Those sensors installed or the automatic developing machine can be omitted in this case.

In the case that the drying air control unit is mounted at the exit of the automatic developing machine, the film conveying speed must be adjusted in accordance with that of the automatic developing machine, but this drying air control unit can be placed in another position in order to be used as the film size stabilizing unit, wherein the conveying speed of the drying unit can be set independently of the automatic developing machine.

Figure 6:
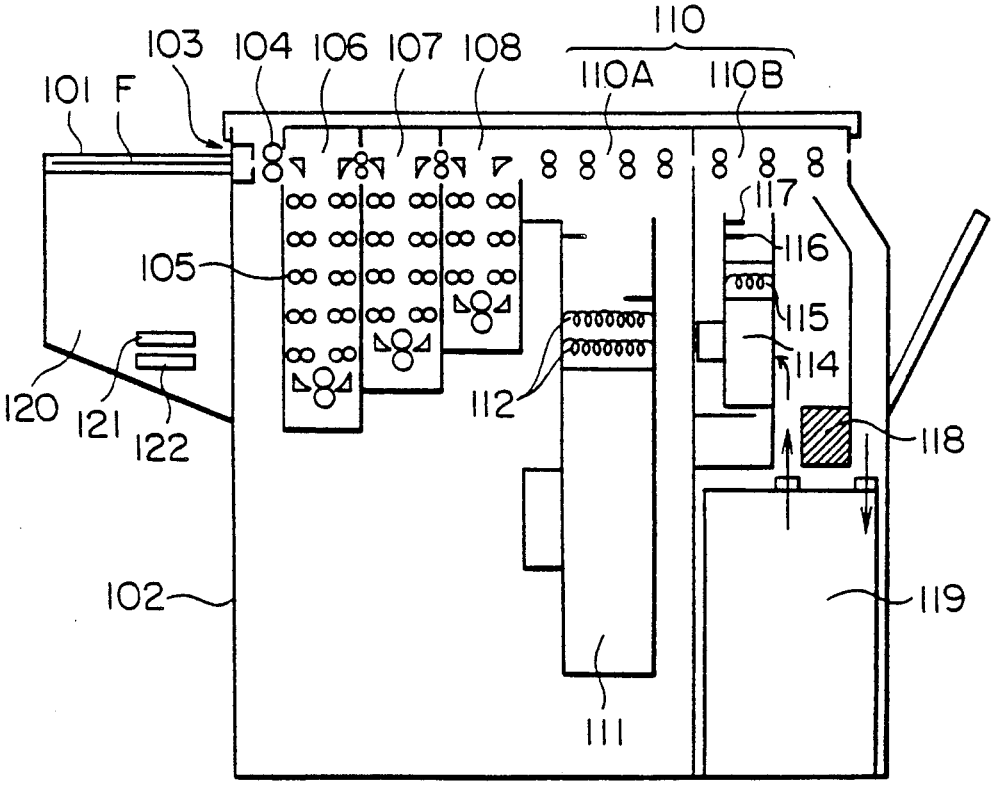
FIG. 6 is a schematic illustration which shows another embodiment of the automatic developing machine of the invention. In this case, the drying unit is divided into two sections.

FIG. 6 is an illustration of an automatic developing machine for carrying out another embodiment of the present invention. The numerals on FIG. 6 which accord with those on FIG. 5 indicate the same units or parts shown on FIG. 5. In this embodiment, the drying air unit 110 of the automatic developing machine is divided to two sections 110A, 110B. The dried air of the entry side section 110A is not automatically controlled for film size stability. The dried air of the delivery side block 110B is automatically controlled in the same way as it is controlled in the case shown in FIG. 5. The relation of position between 110A and 110B is optionally decided. The rollers of the drying air unit 110A and 110B are to be arranged as for the rollers of the processing units 106, 107, 108.

EXAMPLE 5

The experimental data in Table 5, which will be shown later, was obtained by an experiment in which the same samples and chemicals as those in Example 3 are used and the automatic developing machine of the invention shown in FIG. 5 are applied to the experiment.

In the experiment, the samples were exposed to various light conditions according to Table 5. After that, they were processed taking into consideration to reduce the sample size change before and after processing.

In the case that the same drying unit was used in the drying process, the drying capacity of the unit is influenced by the temperature and humidity of the drying air.

Generally speaking, the capacity of a drying unit is indicated by the following formula.

$$C_W = h\frac{(DB - WB)}{\lambda} \cdot t \qquad (1)$$

$C_W$ . . . Drying capacity (g/m)
h . . . Coefficient of heat transfer (Cal/sec ° C. m$^2$)
WB . . . Wet bulb temperature (° C.)
λ. . . Latent heat of vaporization of water (Cal/g)
t . . . Drying time (sec)

It is preferable that the drying unit shown in Example 3 can dry films adequately under various exposing conditions in order to reduce the film size change before and after processing, and that film drying conditions are good.

But the drying capacity is influenced by the drying temperature and humidity as indicated in the formula (1). So the drying unit must have enough capacity to be able to dry films even under the worst conditions. The worst conditions are when the value of (DB−WB) becomes the minimum.

As indicated on Table 5, in the case that the humidity is low when films are exposed, the drying condition is necessary with a low value of (DB−WB). Therefore, the drying conditions when films are exposed to the light in low humidity air, will be explained as follows.

(1) Refer to Table 1 of Example 3.

The minimum value of (DB−WB): 15
Water absorption of film: 13 g/m$^2$
Coefficient of heat transfer: 20 Cal/sec ° C. m$^2$
Latent heat of vaporization: 580 Cal/g The drying time is about 25 sec. as a result of calculations with the formula (1).

If the film size stabilizing device of the invention is installed at the exit of the drying unit that has the same coefficient of heat transfer with the unit mentioned above, the experimental results are described as follows. The following are the preconditions.

Water absorption of film: 13 g/m$^2$
Coefficient of heat transfer (the air drying unit of the automatic developing machine): 20 Cal/sec ° C. m$^2$
Coefficient of heat transfer (the film size stabilizing device of the invention): 20 Cal/sec ° C. m$^2$
Latent heat of vaporization: 580 Cal/g
The time needed to pass through the film size stabilizing device: 5 sec.
The air drying condition of the automatic developing machine: 40° C. 3.5 g/Kg (DB−WB) . . . 22.2° C. (no humidity control)
The condition of the film size stabilizing device: 40° C. 14 g/Kg (DB−WB) . . . 15° C. (humidity control)
(a) The air drying capacity of the film size stabilizing device . . . 2.6 g/m$^2$
(b) The required air drying capacity for the automatic developing machine is 13−2.6=10.4 g/m$^2$, so the air drying time is approximately 13.6 sec. The total time is 5+13.6=18.6 sec. Therefore, the air drying time can be reduced by 6.4 sec. compared with Example 3.

The results of one of the experiments
Exposure: The temperature is 25° C.
The relative humidity is 18%.

| | By the method of Example 3 | By the method of the invention | |
|---|---|---|---|
| Drying time | 25 sec. | 14 sec. + unhumidi-fied | 5 sec. humidi-fied |
| Drying condition | 40° C. 14 g/kg | 40° C. 3.5 g/kg | 40° C. 14 g/kg |
| Size change | +4 μm | +3 μm | |
| Results of drying | α and β | α and β | |

Remarks:
α represents the film condition in which the surface of film is dry and warm.
β represents the film condition in which the surface of film is dry but the surface temperature is low.
α and β represent the middle state between α and β.

The water absorption of film was approximately from 12.5 g/kg to 12.8 g/kg. The coefficient of heat transfer was approximately 21 Cal/sec ° C. m$^2$.

It can be seen that the film drying time can be reduced.

Referring to Table 1, 2, 3, and 4, the drying capacity (DB−WB) can be increased without any film size change by raising both drying temperature and humidity.

But in this case, the drying humidity must be raised as well as the drying temperature. Accordingly, a bigger humidifier is needed to control humidity.

In order to get the same drying capacity as this embodiment described above, the case of Example 3 needs a drying capacity of 55° C., 33 g/kg.

The necessary humidity control ranges to obtain the same size control capacity are described below.

| | Example 2 | Example 3 |
|---|---|---|
| Volume of the drying unit | 150 liters | 150 liters |
| Volume of humidity control unit | 150 liters | 45 liters |
| Range of humidity control | the outside air absolute humidity +30 g/kg | the outside air absolute humidity +10.5 g/kg |

It is evident that the volume for humidity control unit and the humidity control range can be reduced according to the present invention. So the humidifying capacity can be reduced to one tenth compared with the conventional type machine.

Referring now to FIG. 6 to explain the invention in more detail, evaporation is accelerated by the first half 110A of the humidity control unit and the humidity control to stabilize the film size can be conducted in the latter half 110B.

Therefore, the water quantity contained in the film at the entrance point of the drying unit 110B should be within the drying capacity of the drying unit 110B.

The following method can be adopted for film size stabilization.

Controlling the drying temperature of the first half 110A in order to control the quantity of water contained in the film at the entrance point of the latter half 110B while the temperature and humidity are controlled at the latter half 110B of the drying unit.

The quantity of water at the entrance point of the latter half 110B depends on the drying capacity of it. It is preferable that the quantity is less than 5 g/m$^2$. It is more preferable that it is less than 3 g/m$^2$, as in the case indicated in FIG. 5.

When the present invention is put into practice, two methods can be applied. One is to install the drying unit at the delivery port of an automatic developing machine as shown in FIG. 5 and the other is to divide the automatic developing machine drying unit into two sections, for instance, one section only to control the temperature and the other section to control temperature and humidity as shown in FIG. 6. Either method will do. It is possible not to set the drying unit at the delivery exit of an automatic developing machine but to set the unit at a separate place for use as the film size stabilizing device.

TABLE 5

| No. | Exposing Conditions (°C.) | (%) | (g/kg) | Drying Condition (°C.) | (g/kg) | Change of film size (μm) | DB-WB (°C.) | AH (drying air) −AH (outside air) |
|---|---|---|---|---|---|---|---|---|
| 1 | 25 | 18 | 3.5 | 40 | 14 | +4 | 15.0 | +10.5 |
| 2 | 25 | 18 | 3.5 | 45 | 18 | +4 | 16.8 | +14.5 |
| 3 | 25 | 18 | 3.5 | 50 | 26 | +6 | 17.4 | +22.5 |
| 4 | 25 | 18 | 3.5 | 55 | 33 | +7 | 19.1 | +29.5 |
| 5 | 25 | 50 | 10 | 40 | 11.5 | −1 | 16.4 | +1.5 |
| 6 | 25 | 50 | 10 | 45 | 15 | +1 | 18.3 | +5 |
| 7 | 25 | 50 | 10 | 49 | 18 | +1 | 20 | +8 |
| 8 | 25 | 80 | 16 | 51 | 16 | +1 | 22.5 | 0 |
| 9 | 25 | 80 | 16 | 45 | 6 | +1 | 23.6 | −10 |
| 10 | 25 | 80 | 16 | 40 | 4.5 | −2 | 21.2 | −11.5 |

EXAMPLE 6

In the case shown in Table 3, the outside temperature was detected to be 25° C. and the relative humidity was detected to be 18% or the absolute humidity was 3.5 g/Kg. The CPU of the machine chose the conditions as follows in accordance with the film size variation characteristics. The temperature of the drying air: 25° C. The relative humidity of the drying air: 3.5 g/kg.

The drying operation was conducted under the conditions mentioned above, and the results were not good judging from the dryed condition of the film discharged from the machine.

After the drying air temperature was set to 40° C. by the operator, a film was dried by the drying air with the humidity of 14 g/kg which was automatically set by CPU. It was confirmed that the size variation of the film did not get worse and the film was dried perfectly. (Refer to Table 6.)

Formula to compute drying capacity $$C_W = (DB - WB)$$

$C_W$: Drying capacity (g/m$^2$)
DB: Dry bulb temperature (° C.)
WB: Wet bulb temperature (° C.)

It is publicly known that the drying capacity of a drying unit is determined by the above-mentioned formula in the case of a hot air type drying process.

The operator has an option on the method of adjusting the drying capacity of the drying unit. One is to change the temperature setting, and the other is to change the humidity setting.

Examples of settings
(a) Temperature setting
(b) Humidity setting
(c) Either temperature or humidity setting Examples of error displaying
(a) The set value exceeds the control range of the unit.
The set value is determined by the capacity of the unit.
(b) The set value exceeds the film size control range.
(c) It is clear that the film will not be dried perfectly if it is processed by the drying air with the humidity corresponding to the set value of temperature.
(d) The drying air humidity is set in the same way as the case (c) mentioned-above.
The cases of (c) and (d) will be explained in detail as follows. In the case that the drying unit has the drying capacity of 12 g/m$^2$ when the value of (DB−WB) is 10° C., and that the water absorption of film is 12 g/m$^2$, the setting of (DB−WB)<10° C. is not good. Incorrect setting like that can be the cause of faulty drying.

Examples of display by the machine (a) The automatic developing machine displays the range beforehand in which the above-mentioned errors do not occur.
(b) The present drying temperature and humidity are displayed simultaneously or respectively.

TABLE 6

| | Absolute humidity of outside air (g/kg) | Relative humidity of outside air (%) | Temperature of drying air of A.D.M. (°C.) | Absolute humidity of drying air (g/kg) | Change of size before and after processing (μm) | DB-WB (°C.) | The present Invention |
|---|---|---|---|---|---|---|---|
| $A_3$ | 3.5 | 18 | 25 (room temperature) | 3.5 | +7 | 12 | o |
| $B_6$ | 3.5 | 18 | 40 | 14 | +4 | 14.5 | o |

EXAMPLE 7

In the embodiment shown in Table 2, the difference between the environmental conditions when a film is exposed and those around the automatic developing machine causes film size variation. The reason is that the sensors installed in the machine detect the environmental conditions around the developing machine itself. So, if the temperature and humidity conditions around the exposing machine are input to the control unit, the right film size is obtained. Table 7 shows the results of the experiment conducted under the conditions mentioned below.

The environmental conditions around the exposing machine: 25° C. 50%

The environmental conditions around the automatic developing machine: 25° C. 20%

The method of detecting the temperature and humidity around the exposing machine can be employed instead of inputting the temperature and humidity when a film is exposed.

TABLE 7

| | Temperature of drying air of A.D.M. (°C.) | Absolute humidity of drying air (g/kg) | Change of size before and after processing (μm) | The present Invention |
|---|---|---|---|---|
| α | 40 | 13.5 | −30 | |
| β | 40 | 11.5 | −1 | o |

Remarks:
α represents the case wherein the environmental conditions around the developing machine were detected.
β represents the case wherein conditions around the exposing machine were input to the control unit. A.D.M. represents the automatic developing machine.

EXAMPLE 8

In the embodiment shown in Table 2, the difference between the environmental conditions when a film is exposed and those of the automatic developing machine cause size variation of film. Then two experiments were made. They will be explained as follows.

Case B in Table 8: The drying air temperature of the automatic developing machine was fixed and the drying air humidity was reset by the operator.

Case C in Table 8: The drying air humidity of the automatic developing machine was fixed and the drying air temperature was reset by the operator.

The results shown in Table 8 were obtained when the temperature and humidity around the exposing machine were 25° C. and 50%.

TABLE 8

| | Temperature of drying air of A.D.M. (°C.) | Absolute humidity of drying air (g/kg) | Change of size before and after processing (μm) |
|---|---|---|---|
| A | 40 | 11.5 | −1 |
| B | 40 | 13 | −10 |
| | 40 | 15 | −20 |
| | 40 | 10 | +22 |

TABLE 8-continued

| | Temperature of drying air of A.D.M. (°C.) | Absolute humidity of drying air (g/kg) | Change of size before and after processing (μm) |
|---|---|---|---|
| C | 45 | 11.5 | +11 |
| | 50 | 11.5 | +20 |
| | 35 | 11.5 | −13 |

As shown in Table 8, the quantity of film size variation before and after processing is −1 μm under drying condition A, Referring to drying condition B wherein the temperature is fixed and the humidity is changed, and drying condition C wherein the humidity is fixed and the temperature is changed, it can be seen that the quantity of film size variation before and after processing can be controlled under conditions B and C.

From the above, it is concluded that fine adjustment of film size variation is possible by changing either the temperature or the humidity, which were set automatically by the CPU. In this case, the set value of either the temperature or the humidity is changed and that of the other is not changed.

EXAMPLE 9

The inventors proposed the automatic developing machine and the drying air control method which can reduce the film size change before and after the developing process by controlling the drying air temperature and/or humidity in the drying unit utilizing the information about the outside air temperature and humidity detected by sensors. These are referred to in Japanese Patent Applications No. 77662/1988, No. 126592/1988, and No. 140254/1988.

The temperature control and/or humidity control in the prior arts are conducted by ON-OFF Control, Proportional Control, PID Control, and so on. In those control methods, the target figures are not always maintained during the control. The actual figures fluctuate within a fixed range centering around the target figures. As a result, the actual figures approach the target ones. The phenomenon in which the actual controlled figures fluctuate centering around the target figures, is called hunting. According to the inventors' investigation, it turned out that the change of film size occurs among a plurality of films because of hunting.

In the case that a plurality of films are processed continuously, all the films are not processed under the same conditions, but they are processed under different conditions within the hunting range. Accordingly, when a set of original plates is made from three plates or four plates, the size of each plate is different from each other, which is a shortcoming.

The present invention was made to solve the problem by reducing the fluctuation of film size caused by hunting that occurs when the temperature and/or humidity are controlled. Other and further objects, features and advantages of the invention will appear more fully from the following description.

An automatic developing machine with an air drying unit of this invention has one of three structures described below and it has the characteristics that in the case of processing a set of films the humidity hunting period is less than a half of that of the temperature hunting and the humidity hunting period is shorter than the drying time.

(1) The structure in which the outside temperature and humidity are detected and the drying air temperature is automatically controlled according to the information.

(2) The structure in which the outside temperature and humidity are detected and the drying air humidity is automatically controlled.

(3) The structure in which the outside temperature and humidity are detected and the drying air humidity and temperature are automatically controlled.

The automatic developing machine with the air drying unit of the present invention is illustrated in FIG. 6. The drying unit is divided into two sections. The film entry side drying unit section is not connected with the automatic control for film size stabilization. The film delivery side drying unit section is automatically controlled according to one of three structures described below. The drying air humidity hunting period is less than a half of the temperature hunting period and the humidity hunting period is shorter that the drying time of the film delivery side section.

(1) The structure in which the outside air temperature and humidity are detected and the drying air temperature is automatically controlled according to the information about the outside air.

(2) The structure in which the outside air temperature and humidity are detected and the drying air humidity is automatically controlled according to the information about the outside air.

(3) The structure in which the outside air temperature and humidity are detected and the drying air humidity and temperature are automatically controlled according to the information about the outside air.

The present invention includes the points described below.

(1) The detected outside air temperature and/or humidity are the temperature and/or humidity when a film is exposed.

(2) The developing machine has a means to detect the drying air temperature and humidity.

(3) A means to detect the outside air temperature and/or humidity is omitted.

(4) Either the information about the drying air temperature or the drying air humidity is input by an operator and the other is automatically operated.

(5) The information about the outside air humidity is obtained by the information about the drying air humidity.

(6) The information about the outside temperature and/or humidity is input by an operator.

(7) Setting of the drying air temperature and humidity is conducted by an operator and the drying air is controlled according to the set values.

Referring now to FIG. 6, wherein the drying unit 110 of the automatic developing machine is divided into two sections 110A, 110B. The film entry side section 110A does not have any connection with film size stability control. The film delivery side section 110B controls the drying air automatically with the drying air control unit. The arrangement of the sections 110A and 110B can be optional. Needless to say, they can be arranged as the a group of rollers of process units 106, 107, 108 and divided into the left half section and the right half section.

The drying air control of this invention is conducted by the structure described above. For instance, when a set of color original films used in color printing consist of three plates or four plates, and are processed in the drying unit, the periodic fluctuation of the humidity hunting and temperature hunting does not occur synchronously by setting the humidity hunting period to less than ½ of the temperature hunting, and the actual controlled values of humidity are averaged by making the humidity hunting period shorter than the drying time. As a result, when a set of films are processed, the environmental conditions of all films are averaged, and film size changes before and after processing are reduced remarkably for each film. To illustrate this invention, Example 6 has been given above. Advatages of the invention particularly in the case of Example 6 will be described as follows.

An automatic developing machine equipped with a drying air control unit of the present invention can reduce change of film size caused by the hunting of the temperature and humidity of the drying air when they are controlled, and it is possible to stabilize the variation of film size in a set of films. Especially, in the case of making the original color film for color print consisting of three or four plates, the machine of the present invention is very effective to prevent the hunting of the temperature and humidity of the drying air. As a result, the variation of film size is minimized.

The machine, the air drying unit of which is divided into two sections, has the advantages that it can stabilize the variation of film size and it can be made compact since the capacity and the cost of the heater, humidifier, and dehumidifier can be cut down compared with one section type air drying unit.

Having described the invention as related to the embodiment shown in the accompanying drawing, it is our intention that the invention be not limited by any of the details of description, unless otherwise specified, but rather be construed broadly within its spirit and scope as set out in the accompanying claims.

What is claimed is:

1. An apparatus for developing a photographic film having a size variation characteristic, comprising:

means for processing the film with processing solutions to develop an image on the film;

means for drying the processed film;

first means for detecting the outside atmospheric condition;

second means for detecting a drying condition of said drying means;

computation means for obtaining a film size variation on the basis of the outside atmospheric condition, the drying condition, and the size variation characteristic of the film, and for obtaining an optimum drying condition so as to change the film size variation to a desired film size variation; and control means for controlling said drying means so as to provide said optimum drying condition.

2. The apparatus of claim 1, wherein said outside atmospheric condition is the outside air humidity and temperature.

3. The apparatus of claim 1, wherein said computation means has preset values corresponding to a standard outside air humidity and temperature, and a standard drying humidity and temperature.

4. The apparatus of claim 3, wherein, to obtain said optimum drying condition corresponding to the outside air humidity and temperature, said computation means changes one of the standard drying humidity and temperature.

5. The apparatus of claim 3, wherein said computation means changes both the standard drying humidity and temperature.

6. The apparatus of claim 1, wherein said computation means calculates the film size variation based on the relationship:

$$\Delta l_1 = A + \alpha_0(t_0 - t_{s0}) - \beta_0(h_0 - h_{s0}) + \alpha_D(t_D - t_s) - \beta_D(h_D - h_s)$$

$\Delta l_1$: the change of film (%)
$t_0$: the outside air temperature (° C.)
$t_D$: the drying temperature (° C.)
$t_s$: the standard drying temperature (° C.)
$h_0$: the outside humidity (g/kg)
$h_D$: the drying humidity (g/kg)
$h_s$: the standard drying humidity (g/kg) almost equal to the outside humidity
$t_{s0}$: the standard outside temperature (° C.)
$h_{s0}$: the standard outside humidity (g/kg)

7. The apparatus of claim 7 wherein said computation means includes memory means for obtaining rapidly the optimum drying condition.

8. The apparatus of claim 1, wherein said outside atmosphere condition represents the outside air humidity and temperature when the film was subjected to an imagewise exposure.

9. The apparatus of claim 1, wherein said first detecting means comprises a humidity sensor and a temperature sensor.

10. The apparatus of claim 9, wherein said humidity sensor and said temperature sensor are mounted on the apparatus.

11. The apparatus of claim 9, wherein said humidity sensor and said temperature sensor are mounted remote from the apparatus at a position close to an exposure apparatus.

12. The apparatus of claim 9, wherein said detecting means includes means for manually inputting the outside air humidity and temperature.

13. The apparatus of claim 7, wherein, in a hunting characteristic of the control means in which an actual value periodically fluctuates within a range centering around a target value, a hunting period in humidity control is less than half of that in temperature control.

14. The apparatus of claim 13, wherein said hunting period in humidity control is shorter than a drying time to which the film is subjected under said optimum drying condition.

15. A drying apparatus for use with a developing machine in which a photographic film having a size variation characteristic is processed with processing solutions to develop an image thereon, comprising:

means for receiving the processed film from the developing machine;

means for drying the processed film;

means for detecting the outside atmospheric condition;

means for detecting a drying condition of said drying means;

computation means for obtaining a film size variation on the basis of the outside atmospheric condition, the drying condition, and the size variation characteristic of the film, and for obtaining an optimum drying condition so as to change the film size variation to a desired film size variation; and control means for controlling said drying means so as to provide said optimum drying condition.

16. A method of drying a photographic film having a size variation characteristic which has been processed with processing solutions to develop an image thereon by a developing machine, comprising:

drying the processed film in a drying means;

detecting the outside atmospheric condition;

detecting a drying condition of said drying means;

computing a film size variation based on the outside atmospheric condition, the drying condition of the drying means, and the size variation characteristic of the film;

determining an optimum drying condition so as to change said film size variation to a desired film size variation; and controlling the step of drying the processed film to provide said optimum drying condition.

17. The method of claim 16, wherein said outside atmospheric condition is represented by the outside air humidity and temperature.

18. The method of claim 16, wherein the computing step changes at least one of drying humidity and temperature to obtain said optimum drying condition.

19. The method of claim 16, wherein said computing step changes both drying humidity and temperature.

20. The method of claim 17, wherein said outside air humidity and temperature is obtained when the film was subjected to an imagewise exposure.

21. The method of claim 16, wherein said outside atmospheric condition is represented by outside air humidity.

22. The method of claim 21, wherein said determining step changes at least one of drying humidity and temperature to obtain the optimum drying condition.

23. The method of claim 21, wherein said determining step changes both drying humidity and temperature.

24. The method of claim 16, wherein the controlling step determines said film size variation based on the relationship $$\Delta l_1 = A + \alpha_0(t_0 - t_{s0})\beta_0(h_0 - h_{s0}) + \alpha_D(t_D - t_s) - \beta_D(h_D - h_s)$$

$\Delta l_1$: the change of film (%)
$t_0$: the outside air temperature (° C.)
$t_D$: the drying temperature (° C.)
$t_s$: the standard drying temperature (° C.)
$h_0$: the outside humidity (g/kg)
$h_D$: the drying humidity (g/kg)
$h_s$: the standard drying humidity (g/kg) almost equal to the outside humidity
$t_{s0}$: the standard outside temperature (° C.)
$h_{s0}$: the standard outside humidity (g/kg)

* * * * *